US006044588A

United States Patent [19]

Rech

[11] Patent Number: 6,044,588

[45] Date of Patent: Apr. 4, 2000

[54] WINDOW ARRANGEMENT HAVING A VIBRATION GENERATOR TO FACILITATE MOVEMENT OF A WINDOW PANE

[75] Inventor: Bernd Rech, Saarlouis, Germany

[73] Assignee: Volkswagen Ag, Wolfsburg, Germany

[21] Appl. No.: 09/223,922

[22] Filed: Dec. 31, 1998

[30] Foreign Application Priority Data

Jan. 2, 1998 [DE] Germany ..... 198 00 062

[51] Int. Cl.[7] ..... E05F 15/08; E05F 15/20

[52] U.S. Cl. ..... 49/349; 49/31; 49/30; 49/348

[58] Field of Search ..... 49/348, 349, 31, 49/29, 30

[56] References Cited

U.S. PATENT DOCUMENTS

| | | | |
|---|---|---|---|
| 2,115,632 | 4/1938 | Hanley | 74/89.17 |
| 2,175,391 | 10/1939 | Hatossy | 49/348 |
| 4,967,510 | 11/1990 | Torii et al. | 49/358 |
| 5,598,380 | 1/1997 | Saurer et al. | 367/140 |
| 5,806,244 | 9/1998 | Tilli | 49/358 |
| 5,812,684 | 9/1998 | Mark | 381/86 |

FOREIGN PATENT DOCUMENTS

| | | |
|---|---|---|
| 0644350 | 10/1984 | European Pat. Off. . |
| 83348638 | 3/1995 | Germany . |

*Primary Examiner*—Daniel P. Stodola
*Assistant Examiner*—Gregory J. Strimbu
*Attorney, Agent, or Firm*—Baker Botts L.L.P.

[57] ABSTRACT

A window pane is slidably driven in two guides by an electric motor. A piezoelectric vibrator vibrates the window pane to facilitate sliding movement of the window pane relative to the guides and a delay relay enables the vibrator to start operation before the motor is actuated.

3 Claims, 1 Drawing Sheet

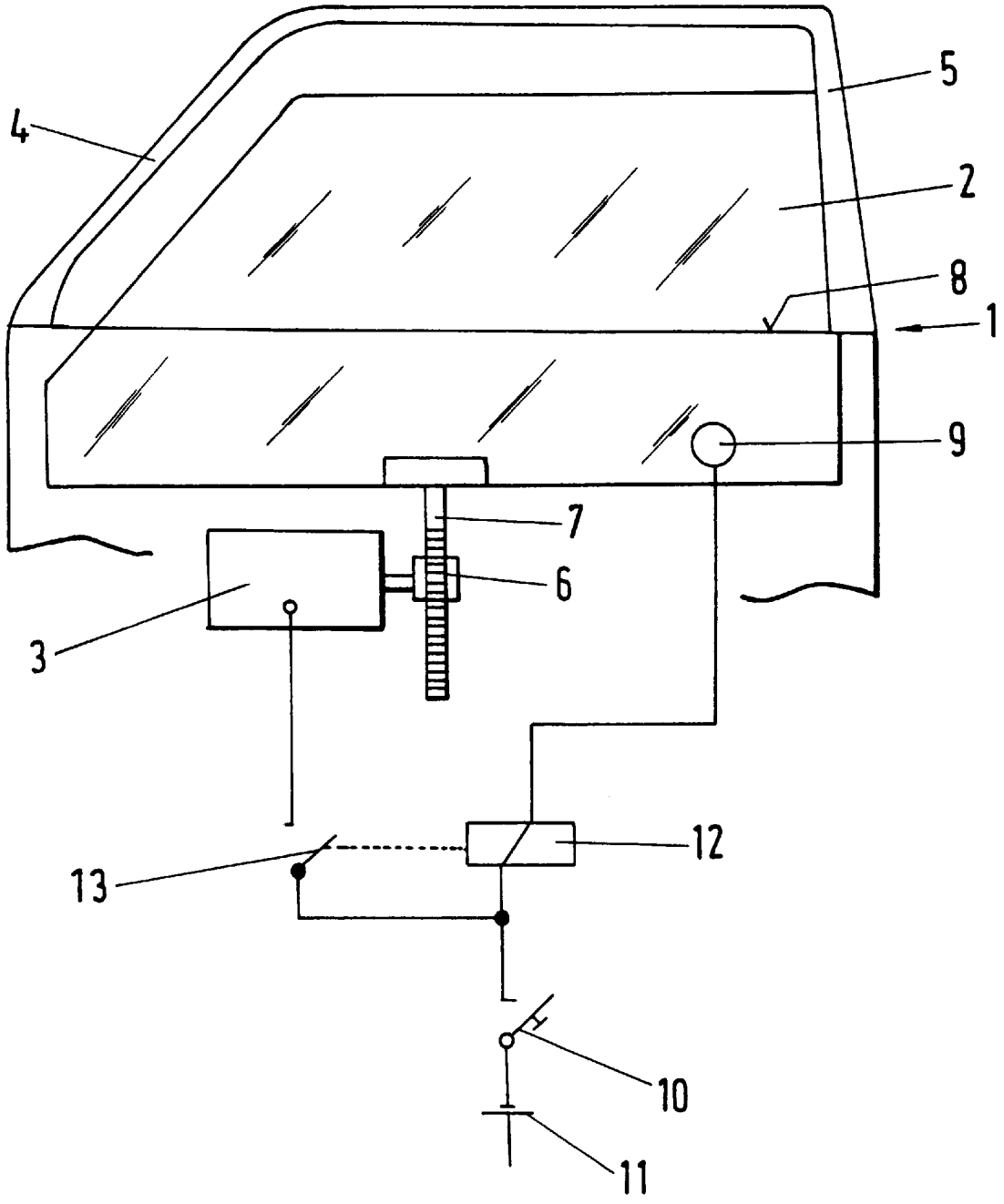
5
4
2
8
1
9
7
6
3
12
13
10
11

WINDOW ARRANGEMENT HAVING A VIBRATION GENERATOR TO FACILITATE MOVEMENT OF A WINDOW PANE

BACKGROUND OF THE INVENTION

This invention relates to window arrangements having a window pane slidable in a guide and having a control for moving the window pane.

In a preferred application of the invention, i.e. a side window arrangement for a motor vehicle, the friction between a window pane and the lateral guides for the pane requires comparatively large driving forces for the sliding motion of the pane in the guides. These driving forces must be exerted by an electric motor in the case of motor actuation of the pane and otherwise by a manually rotated hand crank. For a side window arrangement in a motor vehicle, the pane executes vertical movements as a rule and the drive system must be designed to supply the forces required not only to overcome the maximum friction, which is dependent on temperature and aging, but also to produce the desired window movements in winter when the pane is icy or when the pane is frozen to the guides.

In the introduction to European Published Application No. 64 43 50, which deals with the reduction of squeeze noises and consequent vibration during the movement of a window pane, known window seals for window panes in doors of motor vehicles are described in which the contact pressure of the seal with the pane is reduced during movement of the pane thus reducing the expenditure of motor power to move the pane. However, the described arrangement is not usable in the case of the icing of the window pane as described above. Furthermore, the proposed reduction of contact pressure of the seal with the pane produces a danger of leakage.

Further prior art relating to friction arrangements is classified in Group G 1283/06 of the International Patent Classification but that prior art relates to the reduction of friction by vibration for quite different objects such as measuring instruments.

SUMMARY OF THE INVENTION

Accordingly, it is an object of the invention to provide a window arrangement having a sliding window pane which overcomes disadvantages of the prior art.

Another object of the invention is to provide a window arrangement utilizing simple conventional components by which the forces providing movement of the pane are reduced, in comparison with conventional window arrangements, both as to the frictional component and as to a component of the required driving forces that is attributable to icing.

These and other objects of the invention are attained by providing a window arrangement having a vibration generator for facilitating sliding movement of the pane and a control for causing sliding movement of the pane which triggers the vibration generator before causing a sliding movement of the pane to begin.

In one embodiment the drive control, which may be an electric motor or a manual handle, actuates a piezoelectric transducer to apply vibrations before it starts to move the window pane. For this purpose, an electrical delay element may be provided if the drive is an electric motor.

The invention, therefore, is not merely in the use of vibrations to diminish friction but, to allow for forces attributable to icing, provides a certain sequence of actuation of the vibration generator and the window pane drive. If a manual control is used to move the window pane, in other words a conventional window crank, this can be done by causing the crank to have a certain idle angle of travel at the beginning during which it actuates the vibration generator but does not cause any motion of the window pane until it reaches the end of the idle angle. If an electric motor controls the driving motion of the pane, such as in increasingly employed in modem motor vehicles, there may be a delay element, for example in the nature of a delayed-response relay, between the manual element such as a switch and the electric motor for controlling the pane movement whereas the electrical connection between the switch and the vibration generator, commonly in this case a piezo transducer or an electromagnetic oscillator, contains no delay element.

BRIEF DESCRIPTION OF THE DRAWING

Further objects and advantages of the invention will be apparent from a reading of the following description in conjunction with the accompanying drawing which is a schematic side view illustrating a representative window pane arrangement according to the invention.

DESCRIPTION OF PREFERRED EMBODIMENTS

In the typical embodiment of the invention shown in the drawing, a motor vehicle door 1 is seen from the inside with the usual interior trim removed and a window pane 2 is shown in a partly lowered position between an upper closed position and a lower open position in a window frame having a window sill 8. The window pane 2 is slidably driven along two guides 4 and 5 in the door 1 by an electric motor 3. For this purpose, the drive shaft of the electric motor 3 has a pinion 6 engaging a rack 7 which is affixed to the bottom edge of the pane 2 at a location below the window sill 8.

Also located in the portion of the window pane which is located below the window sill 8, and hence concealed even when the window is closed, is a piezo transducer 9 which constitutes a vibration generator. A manual window drive control element 10, in the form of a switch, is connected to both the electric drive motor 3 and the vibration generator 9 and, upon actuation, the switch electrically connects the parts 3 and 9 to a battery 11 in the vehicle.

After closing of the contact in the switch 10, the vibration generator 9 is connected to the battery immediately, applying a high frequency vibration to the pane 2. On the other hand, the actuation of the electric motor 3 occurs by way of a delayed-response relay 12 having a contact 13 which does not close until after the response time of the relay 12, thereby delaying driving of the window pane.

This means that, during the response time of the relay 12 and hence before any driving of the pane 2 by the electric motor 3 begins, the vibration generator 9 sets the pane 2 in high frequency vibration while still at rest, causing any 'bridges' between the pane 2 and the door 1, due for example to icing or dirt, to be broken. At the beginning of the sliding motion of the pane 2 relative to the door 1, therefore, the electric motor 3 is not required to exert excessive forces to destroy such bridges. Moreover, during the ensuing sliding of the pane 2 in the guides 4 and 5, the driving forces to be applied by the electric motor 3 to the pane 2 are low because the pane 2 continues to vibrate as before, reducing the friction between the pane and its guides 4 and 5.

The window arrangement according to the invention as described above is especially advantageous in that the electric motor 3, or any drive for the sliding movement of the pane 2, may be made smaller and requires less power than in conventional window drive arrangements. This, in turn, means that there is less drain on The battery during operation of the window. An entirely different advantage is that the reduction of friction also improves the dynamics of the movement of the window pane 2 relative to its guides 4 and 5 so that the squeezing noises addressed in European Application No. 64 43 50 discussed above do not occur and any special damping measures against them are unnecessary.

Although the invention has been described herein with reference to specific embodiments, many modifications and variations therein will readily occur to those skilled in the art. Accordingly, all such variations and modifications are included within the intended scope of the invention.

I claim:

1. A window arrangement comprising a window pane, at least one guide for guiding sliding motion of the window pane, a window control and drive system for producing said sliding motion of the window pane, and a vibration generator means for generating relative vibrations between the window pane and the at least one guide to facilitates said sliding motion between the window pane and the at least one guide, wherein the window control and drive system triggers the vibration generator means to generate vibration before producing said sliding motion of the window pane.

2. A window arrangement according to claim 1 wherein the vibration generator means comprises a piezo transducer.

3. A window arrangement according to claim 1 wherein the window control and drive system comprises an electric motor for moving the window pane, and a delay element interposed between the electric motor and an electric switch for initiating operation of the window control and drive system.

* * * * *